US008269597B2

(12) United States Patent
Darr et al.

(10) Patent No.: US 8,269,597 B2
(45) Date of Patent: Sep. 18, 2012

(54) FUSE WITH FUSE STATE INDICATOR

(75) Inventors: Matthew R. Darr, Godfrey, IL (US); Jaime Torrez, Ofallon, MO (US); Anthony C. Ban, Foley, MO (US)

(73) Assignee: Cooper Technologies Company, Houston, TX (US)

( * ) Notice: Subject to any disclaimer, the term of this patent is extended or adjusted under 35 U.S.C. 154(b) by 70 days.

(21) Appl. No.: 11/926,260

(22) Filed: Oct. 29, 2007

(65) Prior Publication Data

US 2009/0108983 A1 Apr. 30, 2009

(51) Int. Cl.
*H01H 85/30* (2006.01)

(52) U.S. Cl. ..... 337/243; 337/206; 337/241; 337/265; 116/206; 116/207; 324/507; 324/550; 340/638

(58) Field of Classification Search ..... 337/243, 337/241, 206, 265; 116/206, 207; 324/507, 324/550; 340/638
See application file for complete search history.

(56) References Cited

U.S. PATENT DOCUMENTS

| | | | | |
|---|---|---|---|---|
| 1,591,029 | A | 7/1926 | Feldkamp | |
| 2,758,295 | A * | 8/1956 | Sundt | 340/638 |
| 2,945,305 | A * | 7/1960 | Strickler | 434/300 |
| 4,070,912 | A * | 1/1978 | McNaughtan et al. | 374/162 |
| 4,308,516 | A * | 12/1981 | Shimada et al. | 337/241 |
| 4,339,207 | A * | 7/1982 | Hof et al. | 374/160 |
| 4,468,137 | A * | 8/1984 | Hilsum et al. | 374/160 |
| 4,484,185 | A * | 11/1984 | Graves | 340/656 |
| 4,538,926 | A * | 9/1985 | Chretien | 374/150 |
| 4,556,874 | A * | 12/1985 | Becker | 340/638 |
| 4,929,090 | A * | 5/1990 | Grahm | 374/102 |
| 5,111,177 | A * | 5/1992 | Krueger et al. | 337/243 |
| 5,738,442 | A * | 4/1998 | Paron et al. | 374/162 |
| 5,776,371 | A * | 7/1998 | Parker | 252/502 |
| 5,821,849 | A * | 10/1998 | Dietsch et al. | 337/241 |
| 5,841,337 | A | 11/1998 | Douglass | |
| 5,936,508 | A * | 8/1999 | Parker | 337/241 |
| 5,994,993 | A * | 11/1999 | Castonguay et al. | 337/206 |
| 6,114,941 | A * | 9/2000 | Scott | 337/332 |
| 6,292,087 | B1 * | 9/2001 | Castonguay et al. | 337/206 |
| 6,456,189 | B1 * | 9/2002 | Mosesian et al. | 337/243 |
| 6,809,627 | B2 * | 10/2004 | Castonguay et al. | 337/243 |
| 2004/0000983 | A1 * | 1/2004 | Kennedy et al. | 337/243 |
| 2004/0169983 | A1 * | 9/2004 | Johnsen et al. | 361/115 |
| 2006/0040546 | A1 * | 2/2006 | Werthman et al. | 439/488 |
| 2008/0129441 | A1 | 6/2008 | Darr et al. | |
| 2008/0191831 | A1 * | 8/2008 | Matyas | 337/198 |
| 2008/0232427 | A1 * | 9/2008 | Leute et al. | 374/161 |

FOREIGN PATENT DOCUMENTS

| | | | |
|---|---|---|---|
| DE | 8514462 | U1 | 2/1987 |
| EP | 313709 | A1 * | 5/1989 |
| GB | 594736 | A | 11/1947 |
| GB | 2135874 | A * | 9/1984 |
| JP | 52141281 | A * | 11/1977 |

OTHER PUBLICATIONS

International Search Report and Written Opinion of PCT/US2008/080441; Feb. 16, 2009; 12 pages.

* cited by examiner

*Primary Examiner* — Anatoly Vortman
(74) *Attorney, Agent, or Firm* — Armstrong Teasdale LLP

(57) ABSTRACT

Fuse state indicators include temperature responsive elements adapted to visually display a number of different fuse states. The displays may include distinct colors and markings that are made visible or concealed from view based on temperature ranges that the fuse is exposed to in use. Various temperature sensitive elements and various markings are disclosed to convey at least three distinct fuse states to interested persons at the location of the fuse.

19 Claims, 10 Drawing Sheets

FUSE WITH FUSE STATE INDICATOR

BACKGROUND OF THE INVENTION

This invention relates generally to fuses and, more particularly, to fuses with a fuse state indicator.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

Figure 1:
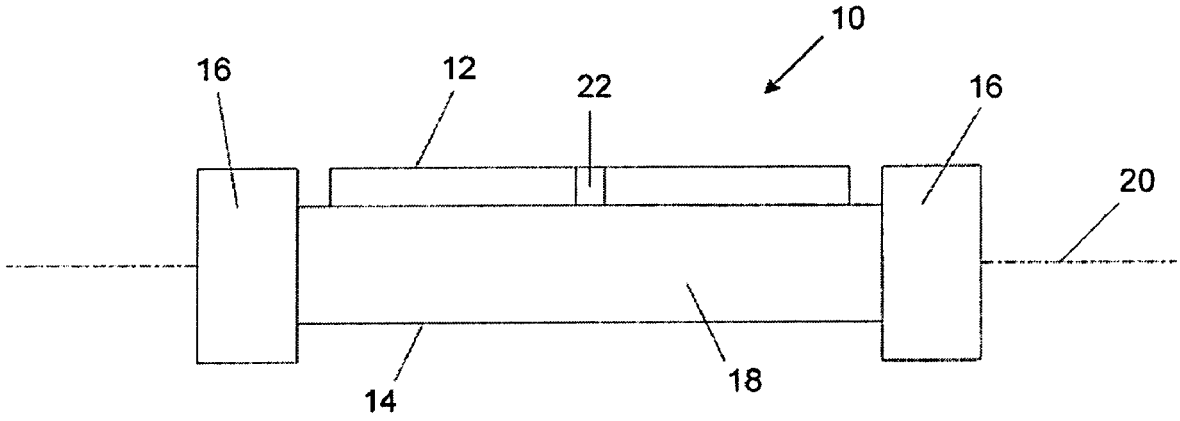
FIG. 1 is a plan view of a fuse comprising a fuse state indicator that responds to temperature in accordance with an exemplary embodiment.

FIG. 1 is a plan view of an exemplary embodiment of a fuse 10 comprising a fuse state indicator 12 that responds to heat being generated from the body of fuse 10. The fuse 10 includes an insulative (i.e., nonconductive) fuse body 14 and conductive ferrules 16 attached thereto on either end thereof. The fuse state indicator 12 extends on an outer surface 18 of the fuse body 14 between the ferrules 16 and is not electrically connected to the ferrules 16. The fuse body 14 is elongated in the direction of a longitudinal axis 20 and is generally cylindrical in the illustrated embodiment. It is appreciated that the benefits of the instant invention may also apply to non-cylindrical fuses, including but not limited to rectangular fuses, in alternative embodiments. Further, it is understood that the invention is applicable to a wide variety of fuses intended for a wide variety of applications and having a wide variety of fuse ratings. Therefore, the embodiments of the invention shown and described herein are for illustrative purposes only, and the invention is not intended to be restricted to a particular fuse type, class, or rating.

In an exemplary embodiment, the ferrules 16 are generally cylindrical and complementary in shape to the fuse body 14. It is, however, appreciated that the benefits of the instant invention may also apply to non-cylindrical ferrules, including but not limited to rectangular ferrules, in alternative embodiments.

The fuse state indicator 12 comprises at least one temperature sensitive element 22 capable of undergoing a visible change upon being subjected to various temperature ranges. The temperature sensitive element 22 is adapted to visibly indicate the state of fuse 10. The state of fuse 10 may be indicated as inoperable due to the fuse 10 not being installed properly or the circuit being off, operable within normal temperature limits, operable but exceeding normal temperature limits, and/or open fuse due to a short circuit or an overload. Other fuse states and other descriptions for the fuse states may be used in alternative embodiments without departing from the scope and spirit of the exemplary embodiment. The temperature sensitive element 22 may be employed as part of the fuse state indicator 12 coupled to the outer surface 18 of the fuse 10 or the temperature sensitive element 22 may be employed independently. The temperature sensitive element 22 is coupled to the outer surface 18 of the fuse body 14 between the ferrules 16 and is not electrically connected to the ferrules 16.

Figure 2:
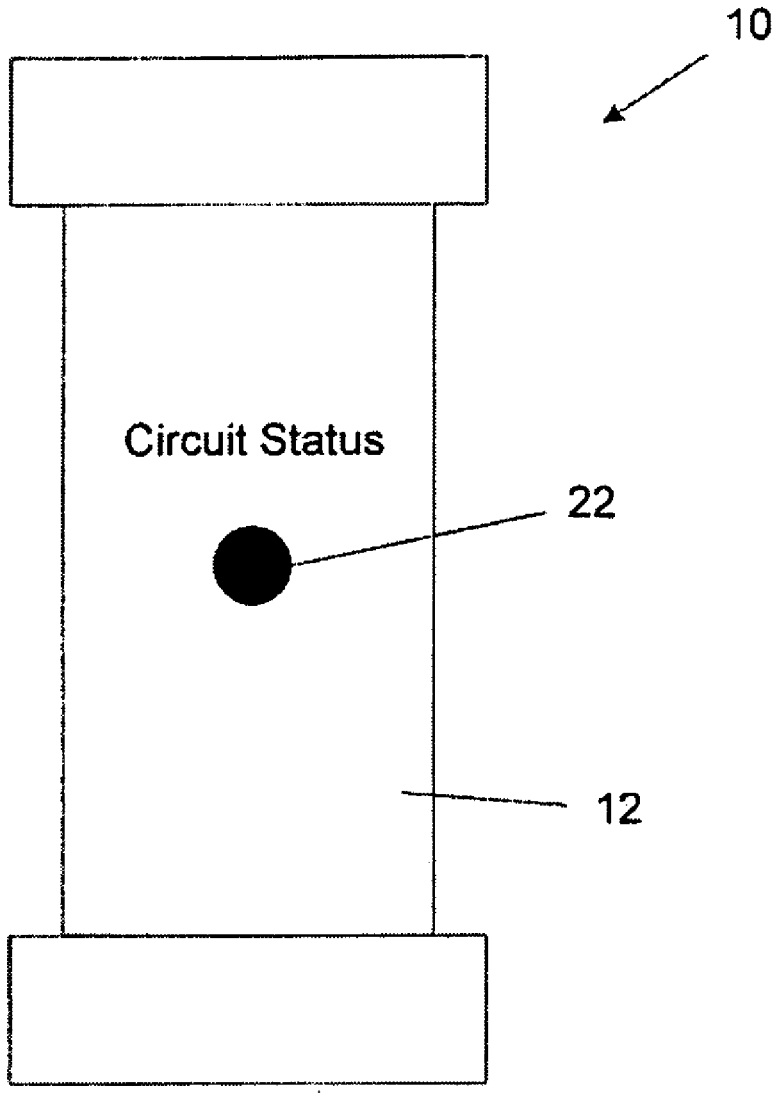
FIG. 2 is a top view of a fuse comprising a fuse state indicator displaying a fuse state in accordance with an exemplary embodiment.

FIG. 2 is a top view of a fuse 10 comprising a fuse state indicator 12 displaying a fuse state in accordance with an exemplary embodiment. As illustrated here, the fuse state indicator 12 comprises the temperature sensitive element 22, which is capable of undergoing a visible change upon being subjected to various temperature ranges. In an exemplary embodiment, the visible change the temperature sensitive element 22 experiences comprises a plurality of color changes. These plurality of color changes are dependent upon the temperature ranges the temperature sensitive element 22 is exposed to.

Figure 3A:
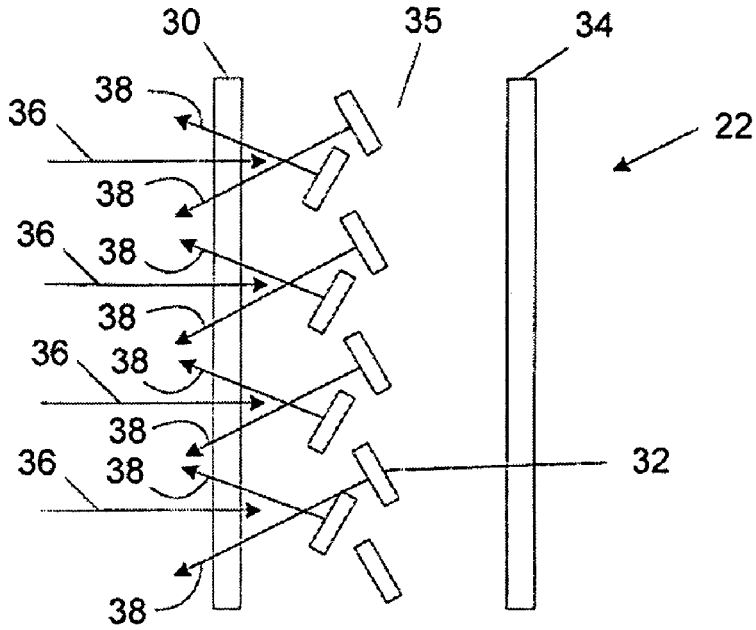
FIG. 3A is a perspective view of a temperature sensitive element showing the light reflectance at one temperature in accordance with an exemplary embodiment.

FIG. 3A is a perspective view of a temperature sensitive element 22 showing the light reflectance at one temperature in accordance with an exemplary embodiment. As illustrated here, the temperature sensitive element 22 comprises a transparent lens 30, a plurality of thermochromic liquid crystals 32 adjacent to the transparent lens 30 and a backing layer 34 adjacent to the plurality of thermochromic liquid crystals 32.

These thermochromic liquid crystals 32 are liquid crystals capable of displaying different colors at different temperature ranges. This color change is dependent on selective reflection of certain wavelengths by the crystallic structure of the material. This selective reflection occurs as the material changes between the low-temperature crystallic phase, through the anisotropic chiral or twisted nematic phase, to the high-temperature isotropic liquid phase. However, only the nematic mesophase has thermochromic properties, thereby restricting the effective operating temperature range of the material for experiencing a plurality of color changes. It is understood that the effective operating temperature range of the material may vary depending upon the type of thermochromic liquid crystal 32 selected.

The twisted nematic phase has the molecules oriented in layers with regularly changing orientation, which gives them periodic spacing. The light passing through the crystal undergoes Bragg diffraction on these layers, and the wavelength with the greatest constructive interference is reflected back. This reflected wavelength of light is perceived as a spectral color.

In FIG. 3A, the thermochromic liquid crystals 32 are oriented in a first crystallic structure 35 according to the temperature the thermochromic liquid crystals 32 are experiencing. A light 36 is shown to pass through the first crystallic structure 35, wherein a first reflected wavelength of light 38 is reflected back. Thus, the first reflected wavelength of light 38 experiences the greatest constructive interference. The first reflected wavelength of light 38 is associated with a viewer visualizing a first color that is associated with a fuse state.

Figure 3B:
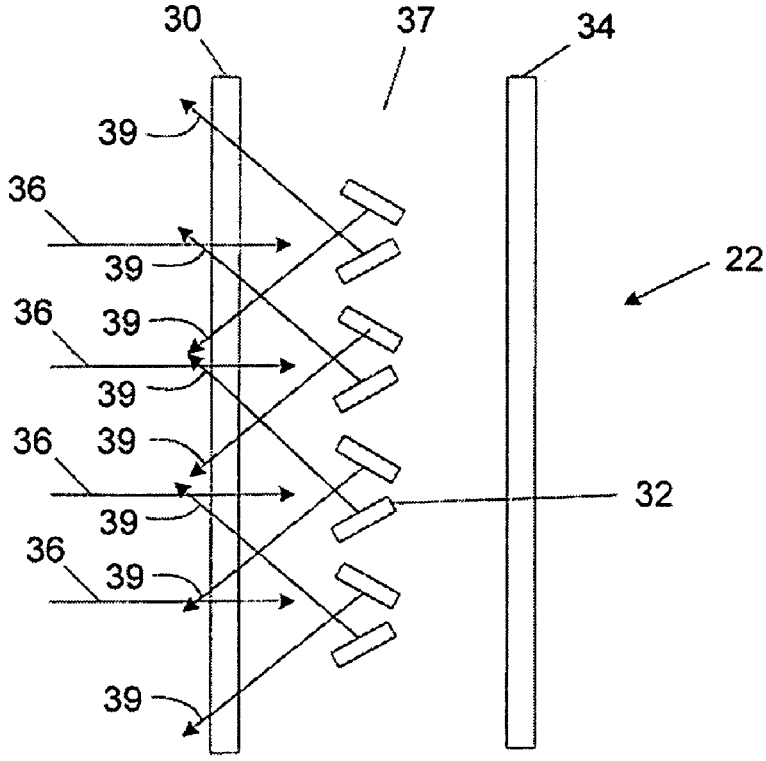
FIG. 3B is a perspective view of a temperature sensitive element showing the light reflectance at another temperature in accordance with an exemplary embodiment.

FIG. 3B is a perspective view of a temperature sensitive element 22 showing the light reflectance at another temperature in accordance with an exemplary embodiment. As the thermochromic liquid crystals 32 undergo changes in temperature, thermal expansion occurs, resulting in change of spacing between the layers, and therefore a change in the reflected wavelength of light. As illustrated here, the thermochromic liquid crystals 32 are oriented in a second crystallic structure 37 according to the temperature the thermochromic liquid crystals 32 are experiencing. A light 36 is shown to pass through the second crystallic structure 37, wherein a second reflected wavelength of light 39 is reflected back. Thus, the second reflected wavelength of light 39 experiences the greatest constructive interference. The second reflected wavelength of light 39 is associated with a viewer visualizing a second color that is associated with another fuse state.

The color of the thermochromic liquid crystals 32 may therefore continuously range from black through the spectral colors to black again, depending on the temperature. A few examples of thermochromic liquid crystals include, but are not limited to, cholesteryl nonanoate and cyanobiphenyls.

Since fuses come in different sizes and have a variety of ratings, temperature ranges for the various states of fuse 10 may differ from one type of fuse to another. For example, one fuse may have a lower normal operating temperature range than another. Similarly, one fuse may have a lower short circuit or overload temperature range than another fuse. Thus, the type of thermochromic liquid crystal 32 that is used may depend upon the size and rating of the fuse.

Referring back to FIG. 2, the temperature element 22 may turn a first color during a first temperature range indicating that the fuse 10 is inoperable due to the fuse 10 not being installed properly or the circuit being off. When the temperature sensitive element 22 experiences a temperature falling within the first temperature range, the color change of the temperature sensitive element 22 may be reversible. The temperature element may change to a second color during a second temperature range indicating that the fuse 10 is operating within normal temperature limits. When the temperature sensitive element 22 experiences a temperature falling within the second temperature range, the color change of the temperature sensitive element 22 may be reversible. Additionally, the temperature element 22 may change to a third color during a third temperature range indicating that the fuse 10 is operating but exceeding normal temperature limits. When the temperature sensitive element 22 experiences a temperature falling within the third temperature range, the color change of the temperature sensitive element 22 may be reversible. Furthermore, the temperature element 22 may change to a fourth color during a fourth temperature range indicating that the fuse 10 is open due to a short circuit or an overload. When the temperature sensitive element 22 experiences a temperature falling within the fourth temperature range, the color change of the temperature sensitive element 22 may be irreversible.

Although only one color change per temperature range has been illustrated, other embodiments may include multiple color changes within a temperature range associated with one status of the fuse 10 without departing from the scope and spirit of the exemplary embodiment.

The fuse state indicator 12 may comprise lettering to describe the fuse 10 and the states of the fuse. The fuse state indicator 12 may also comprise a color chart for assisting an operator in identifying the meaning of the plurality of color changes. To further assist operators in analyzing the state of the fuse 10, pocket cards comprising color charts may be provided to the operators.

Additionally, although the exemplary embodiment described above illustrates the fuse 10 comprising one temperature sensitive element 22, multiple temperature sensitive elements 22 may be utilized without departing from the scope and spirit of the exemplary embodiment.

Figure 4:
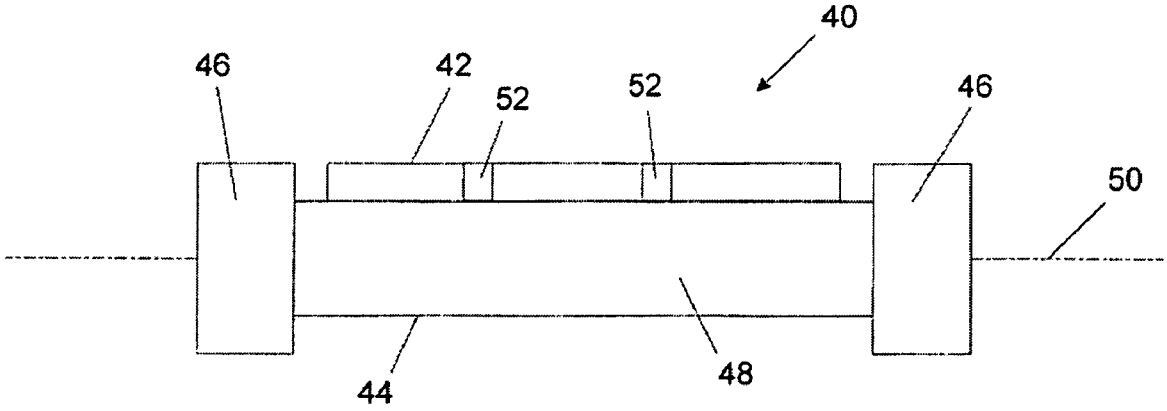
FIG. 4 is a plan view of a fuse comprising at least one fuse state indicator that responds to temperature in accordance with a second exemplary embodiment.

FIG. 4 is a plan view of a fuse comprising at least one fuse state indicator that responds to temperature in accordance with a second exemplary embodiment. The fuse 40 includes an insulative (i.e., nonconductive) fuse body 44 and conductive ferrules 46 attached thereto on either end thereof. The fuse state indicator 42 extends on an outer surface 48 of the fuse body 44 between the ferrules 46 and is not electrically connected to the ferrules 46. The fuse body 44 is elongated in the direction of a longitudinal axis 50 and is generally cylindrical in the illustrated embodiment. It is appreciated that the benefits of the instant invention may also apply to non-cylindrical fuses, including but not limited to rectangular fuses, in alternative embodiments. Further, it is understood that the invention is applicable to a wide variety of fuses intended for a wide variety of applications and having a wide variety of fuse ratings. Therefore, the embodiments of the invention shown and described herein are for illustrative purposes only, and the invention is not intended to be restricted to a particular fuse type, class, or rating.

In an exemplary embodiment, the ferrules 46 are generally cylindrical and complementary in shape to the fuse body 44. It is, however, appreciated that the benefits of the instant invention may also apply to non-cylindrical ferrules, including but not limited to rectangular ferrules, in alternative embodiments.

The fuse state indicator 42 comprises at least one temperature sensitive element 52 capable of undergoing a visible change upon being subjected to a particular temperature range. The temperature sensitive element 52 is adapted to visibly indicate the state of fuse 40. The state of fuse 40 may be indicated as inoperable due to the fuse 40 not being installed properly or the circuit being off, operable within normal temperature limits, operable but exceeding normal temperature limits, and/or open fuse due to a short circuit or an overload. The temperature sensitive element 52 may be employed as part of the fuse state indicator 42 coupled to the outer surface 48 of the fuse 40 or the temperature sensitive element 52 may be employed independently. The temperature sensitive element 52 is coupled to the outer surface 48 of the fuse body 44 between the ferrules 46 and is not electrically connected to the ferrules 46.

Figure 5A:
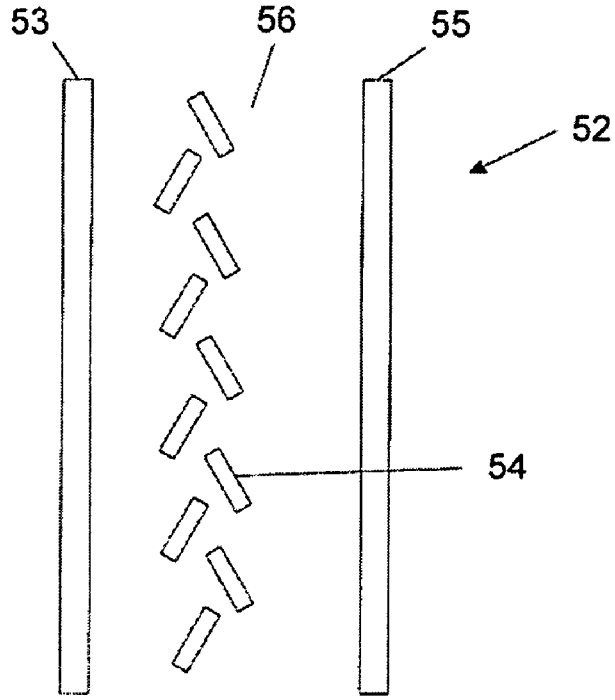
FIG. 5A is a perspective view of a temperature sensitive element showing a plurality of thermochromic liquid crystals at one temperature in accordance with an exemplary embodiment.
Figure 5B:
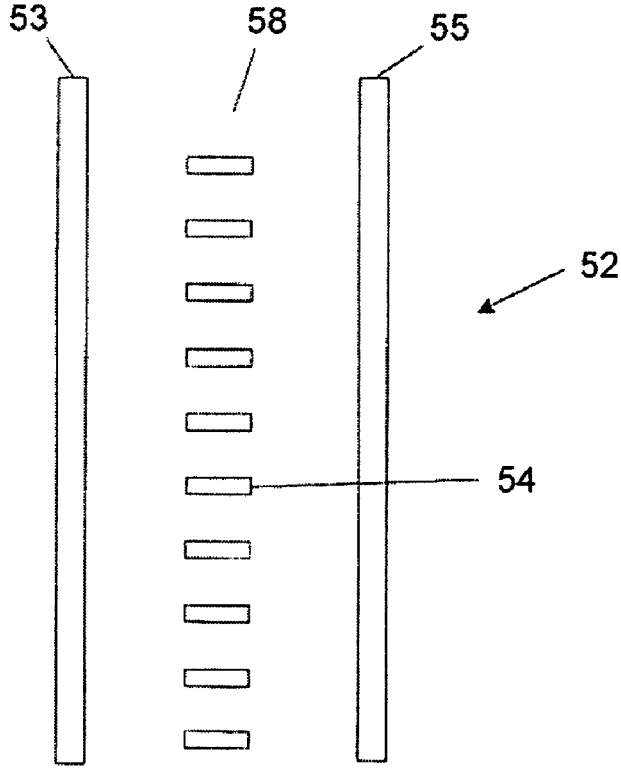
FIG. 5B is a perspective view of a temperature sensitive element showing a plurality of thermochromic liquid crystals at another temperature in accordance with an exemplary embodiment.

Referring now to FIGS. 5A and 5B, the temperature sensitive element is illustrated and its operation is described hereinbelow in accordance with an exemplary embodiment. FIG. 5A is a perspective view of a temperature sensitive element 52 showing a plurality of thermochromic liquid crystals 54 at one temperature in accordance with an exemplary embodiment. FIG. 5B is a perspective view of a temperature sensitive element showing a plurality of thermochromic liquid crystals at another temperature in accordance with an exemplary embodiment. As illustrated in these Figures, the temperature sensitive element 52 comprises a transparent lens 53, a plurality of thermochromic liquid crystals 54 adjacent to the transparent lens 53 and a backing layer 55 adjacent to the plurality of thermochromic liquid crystals 54.

These thermochromic liquid crystals 54 are liquid crystals capable of changing its orientation from a first orientation 56, wherein a substantial portion of the light does not pass through the layer of thermochromic liquid crystals 54, to a second orientation 58, wherein a substantial portion of the light passes through the layer of thermochromic liquid crystals 54, and possibly back to the first orientation 56 upon exposure to various temperature ranges. When the thermochromic liquid crystals 54 are positioned in the second orientation 58, the molecules are pointed mostly in the same direction. These orientational changes may be reversible or irreversible depending upon the thermochromic liquid crystals 54 used and/or the temperature ranges the thermochromic liquid crystals 54 are exposed to.

Referring now to FIGS. 6-9, the various states of the fuse 60 are illustrated. In the embodiment shown in FIGS. 6-9, a fuse state indicator 62 comprising four (4) temperature sensitive elements, an off status temperature sensitive element 64, an on status temperature sensitive element 66, a too hot status temperature sensitive element 68, and a short circuit and overload status temperature sensitive element 70, are illustrated.

Similar to the temperature sensitive element 52 illustrated in FIGS. 5A and 5B, the off status temperature sensitive element 64 of FIGS. 6-9 comprises a transparent lens 53, a plurality of thermochromic liquid crystals 54 adjacent to the transparent lens 53, a backing layer 55 adjacent to the plurality of thermochromic liquid crystals 54 and a first marking 65 coupled to the backing layer 55, wherein the first marking 65 indicates that the fuse 60 is not installed properly or the circuit is off. Although this embodiment uses the word "off" as the first marking 65, any marking may be used, including a particular color, e.g. black dot or square, or any other marking associated with an off status, without departing from the scope and spirit of the exemplary embodiment. The first marking 65 may be marked on the surface of the backing layer 55 or may be marked on a material directly or indirectly coupled to the backing layer 55.

Similar to the temperature sensitive element 52 illustrated in FIGS. 5A and 5B, the on status temperature sensitive element 66, of FIGS. 6-9, comprises a transparent lens 53, a plurality of thermochromic liquid crystals 54 adjacent to the transparent lens 53, a backing layer 55 adjacent to the plurality of thermochromic liquid crystals 54 and a second marking 67 coupled to the backing layer 55, wherein the second marking 67 indicates that the fuse 60 is in normal operation. Although this embodiment uses the word "on" as the second marking 67, any marking may be used, including a particular color, e.g. green dot or square, or any other marking associated with an on status, without departing from the scope and spirit of the exemplary embodiment. The second marking 67 may be marked on the surface of the backing layer 55 or may be marked on a material directly or indirectly coupled to the backing layer 55.

Similar to the temperature sensitive element 52 illustrated in FIGS. 5A and 5B, the too hot status temperature sensitive element 68, of FIGS. 6-9, comprises a transparent lens 53, a plurality of thermochromic liquid crystals 54 adjacent to the transparent lens 53, a backing layer 55 adjacent to the plurality of thermochromic liquid crystals 54 and a third marking 69 coupled to the backing layer 55, wherein the third marking 69 indicates that the fuse 60 is operating at a temperature exceeding the temperature range of normal operation. Although this embodiment uses the word "too hot" as the third marking 69, any marking may be used, including a particular color, e.g. red dot or square, or any other marking associated with a too hot status, without departing from the scope and spirit of the exemplary embodiment. The third marking 69 may be marked on the surface of the backing layer 55 or may be marked on a material directly or indirectly coupled to the backing layer 55.

Similar to the temperature sensitive element 52 illustrated in FIGS. 5A and 5B, the short circuit and overload status temperature sensitive element 70, of FIGS. 6-9, comprises a transparent lens 53, a plurality of thermochromic liquid crystals 54 adjacent to the transparent lens 53, a backing layer 55 adjacent to the plurality of thermochromic liquid crystals 54 and a fourth marking 71 coupled to the backing layer 55, wherein the fourth marking 71 indicates that the fuse 60 has experienced a short circuit or an overload. Although this embodiment uses a black dot as the fourth marking 71, any marking may be used, including words, e.g. failed, or any other marking associated with a short circuit or overload status, without departing from the scope and spirit of the exemplary embodiment. The fourth marking 69 may be marked on the surface of the backing layer 55 or may be marked on a material directly or indirectly coupled to the backing layer 55.

Figure 6:
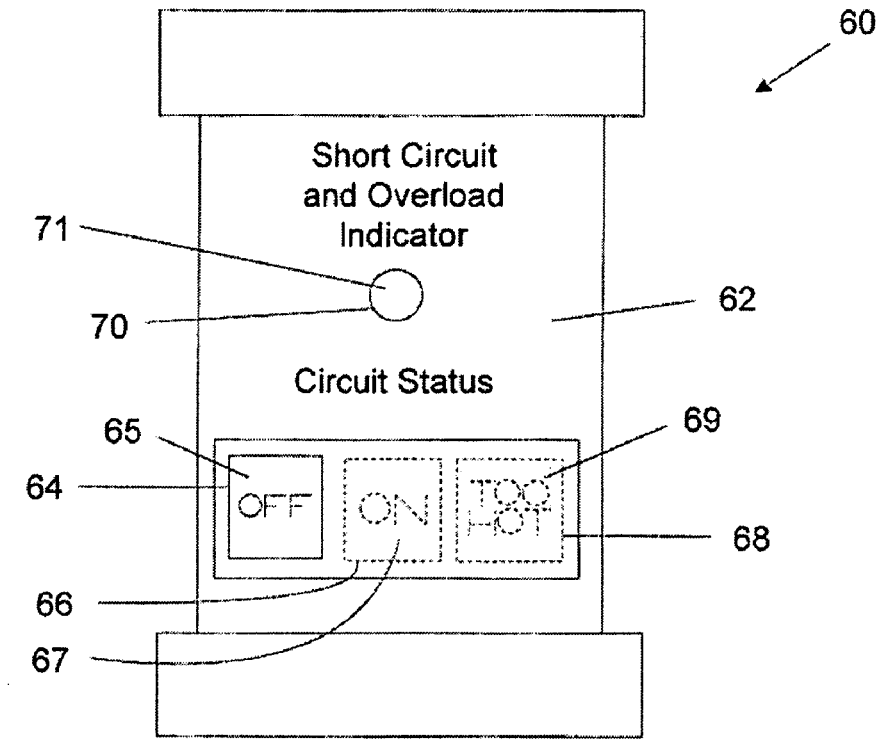
FIG. 6 is a top view of a fuse comprising a fuse state indicator displaying an off fuse state in accordance with an exemplary embodiment.

FIG. 6 is a top view of a fuse comprising a fuse state indicator displaying an off fuse state in accordance with an exemplary embodiment. When the fuse 60 is experiencing a temperature within a first temperature range, the thermochromic liquid crystals within the off status temperature sensitive element 64 orient to the second position, which is when the molecules point in mostly the same direction and allow the operator to view the first marking 65. The thermochromic liquid crystals within the on status temperature sensitive element 66, the too hot status temperature sensitive element 68, and the short circuit and overload status temperature sensitive element 70 remain oriented in the first position, which prevents the operator from viewing the respective associated markings 67, 69, 71. The orientation of the thermochromic liquid crystals of the off status temperature sensitive element 64 may be reversible when the temperature rises above the first temperature range. The fuse state indicator 62 registers the first marking 65, which is "OFF" in this embodiment, when the fuse temperature falls below the minimum operating temperature.

Figure 7:
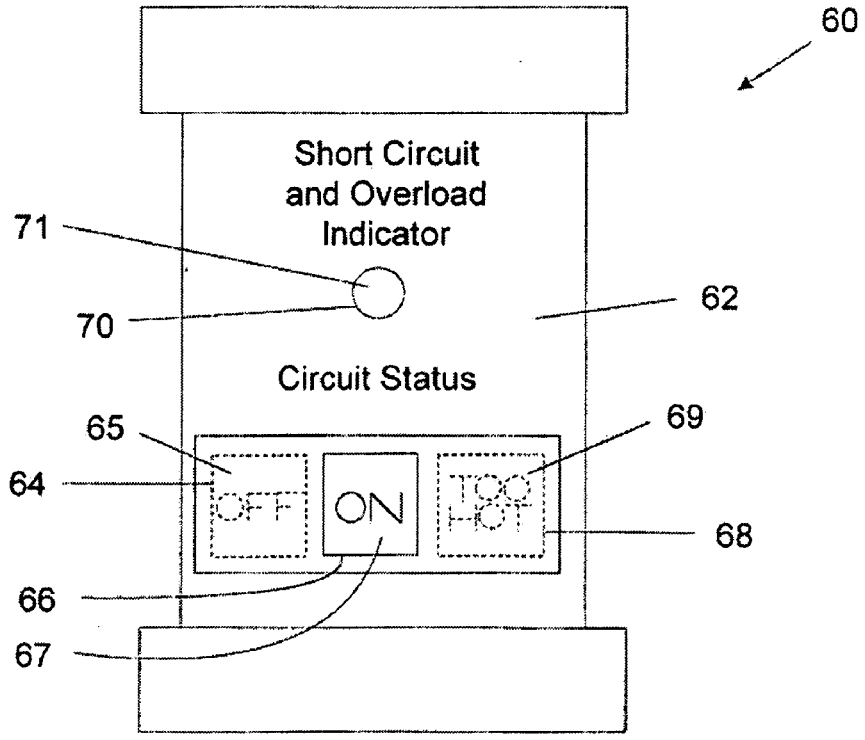
FIG. 7 is a top view of a fuse comprising a fuse state indicator displaying an on fuse state in accordance with an exemplary embodiment.

FIG. 7 is a top view of a fuse comprising a fuse state indicator displaying an on fuse state in accordance with an exemplary embodiment. When the fuse 60 is experiencing a temperature within a second temperature range, the thermochromic liquid crystals within the on status temperature sensitive element 66 orient to the second position, which is when the molecules point in mostly the same direction and allow the operator to view the second marking 67. The thermochromic liquid crystals within the off status temperature sensitive element 64, the too hot status temperature sensitive element 68, and the short circuit and overload status temperature sensitive element 70 remain oriented in the first position, which prevents the operator from viewing the respective associated markings 65, 69, 71. The orientation of the thermochromic liquid crystals of the on status temperature sensitive element 66 may be reversible when the temperature rises above the second temperature range or falls below the second temperature range. The fuse state indicator 62 registers the second marking 67, which is "ON" in this embodiment, when the fuse temperature is within normal operating temperature range.

Figure 8:
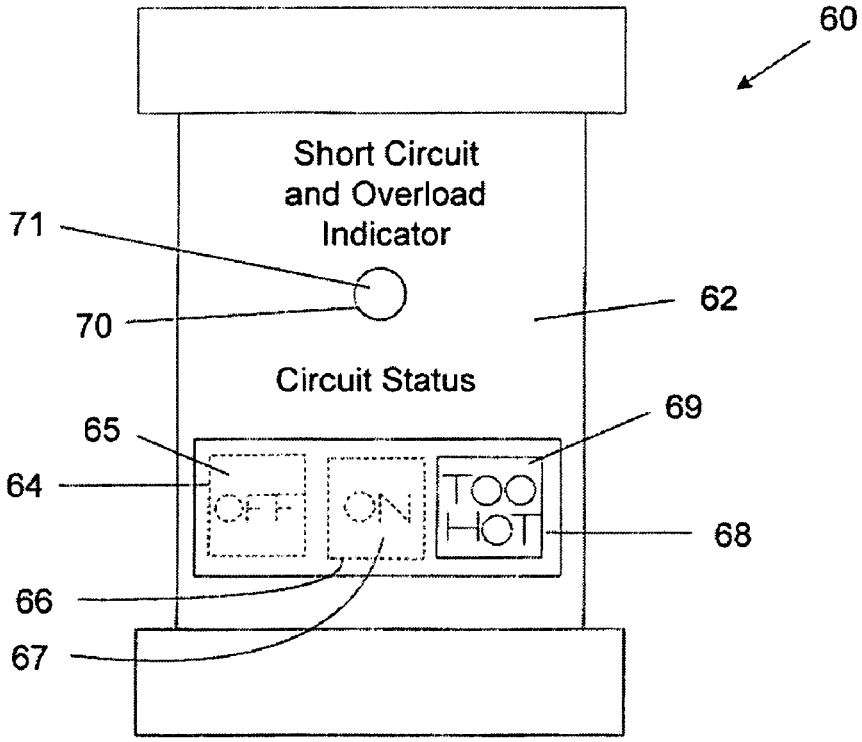
FIG. 8 is a top view of a fuse comprising a fuse state indicator displaying a too hot fuse state in accordance with an exemplary embodiment.

FIG. 8 is a top view of a fuse comprising a fuse state indicator displaying a too hot fuse state in accordance with an exemplary embodiment. When the fuse 60 is experiencing a temperature within a third temperature range, the thermochromic liquid crystals within the too hot status temperature sensitive element 68 orient to the second position, which is when the molecules point in mostly the same direction and allow the operator to view the third marking 69. The thermochromic liquid crystals within the off status temperature sensitive element 64, the on status temperature sensitive element 66, and the short circuit and overload status temperature sensitive element 70 remain oriented in the first position, which prevents the operator from viewing the respective associated markings 65, 67, 71. The orientation of the thermochromic liquid crystals of the too hot status temperature sensitive element 68 may be reversible when the temperature rises above the third temperature range or falls below the third temperature range. The fuse state indicator 62 registers the third marking 69, which is "TOO HOT" in this embodiment, when the fuse temperature has elevated above normal operating temperature but below short circuit and overload temperature range. The third marking 69 registering would warn of possible upcoming failure to the fuse 60 due to extended thermal stress.

Figure 9:
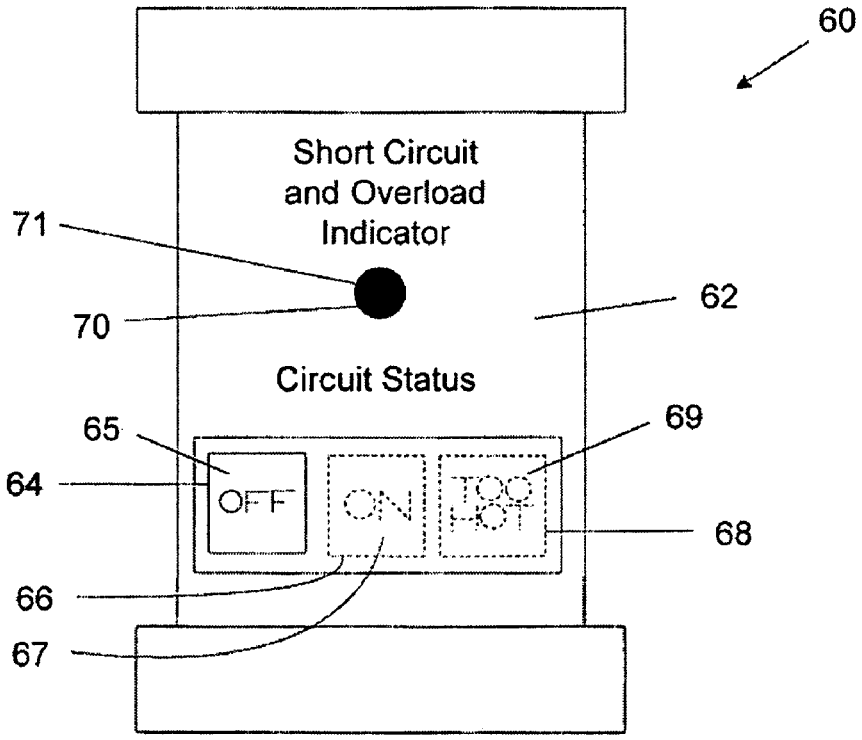
FIG. 9 is a top view of a fuse comprising a fuse state indicator displaying a short circuit and overload fuse state in accordance with an exemplary embodiment.

FIG. 9 is a top view of a fuse comprising a fuse state indicator displaying a short circuit and overload fuse state in accordance with an exemplary embodiment. When the fuse 60 is experiencing a temperature within a fourth temperature range, the thermochromic liquid crystals within the short circuit and overload status temperature sensitive element 70 orient to the second position, which is when the molecules point in mostly the same direction and allow the operator to view the fourth marking 71. The thermochromic liquid crystals within the off status temperature sensitive element 64, the on status temperature sensitive element 66, and the too hot status temperature sensitive element 68 remain oriented in the first position, which prevents the operator from viewing the respective associated markings 65, 67, 69. The orientation of the thermochromic liquid crystals of the short circuit and overload status temperature sensitive element 70 may be irreversible once the temperature falls within the fourth temperature range. Additionally, once the fuse 60 experiences a short circuit or overload status, the fuse 60 eventually cools to a temperature within the first temperature range, resulting in the thermochromic liquid crystals within the off status temperature sensitive element 64 orienting to the second position, which allows the operator to view the first marking 65. The fuse state indicator 62 registers the fourth marking 71, which is "a black dot" in this embodiment, when the fuse temperature has elevated to within the short circuit or overload temperature range. Thus, once the fuse 60 experiences a short circuit or an overload and after a period of time has elapsed for the fuse 60 to cool down, the fuse state indicator 62 registers the first marking 65 and the fourth marking 71.

Figure 10:
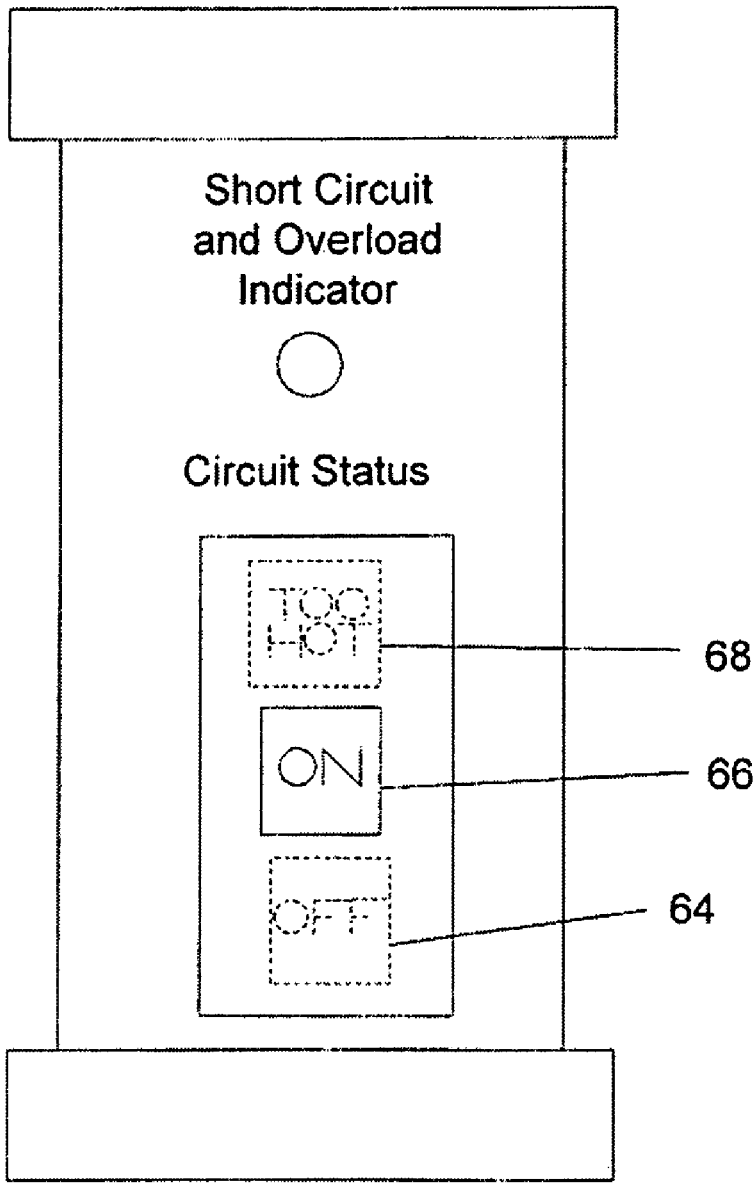
FIG. 10 is a top view of a fuse comprising a fuse state indicator displaying an on fuse state in accordance with an exemplary embodiment.

FIG. 10 is a top view of a fuse comprising a fuse state indicator displaying an on fuse state in accordance with an exemplary embodiment. The embodiment shown here is similar to the embodiments illustrated in FIGS. 4-9, except that the positioning of the off status temperature sensitive element 64, the on status temperature sensitive element 66, and the too hot status temperature sensitive element 68 is vertical, instead of horizontal. It should be understood that the position of the temperature sensitive elements may be in any position, including, but not limited to, horizontal, vertical, diagonal, zigzag, staggered or any other position, which is capable of being viewed by an operator once installed without departing from the scope and spirit of the exemplary embodiment.

Figure 11A:
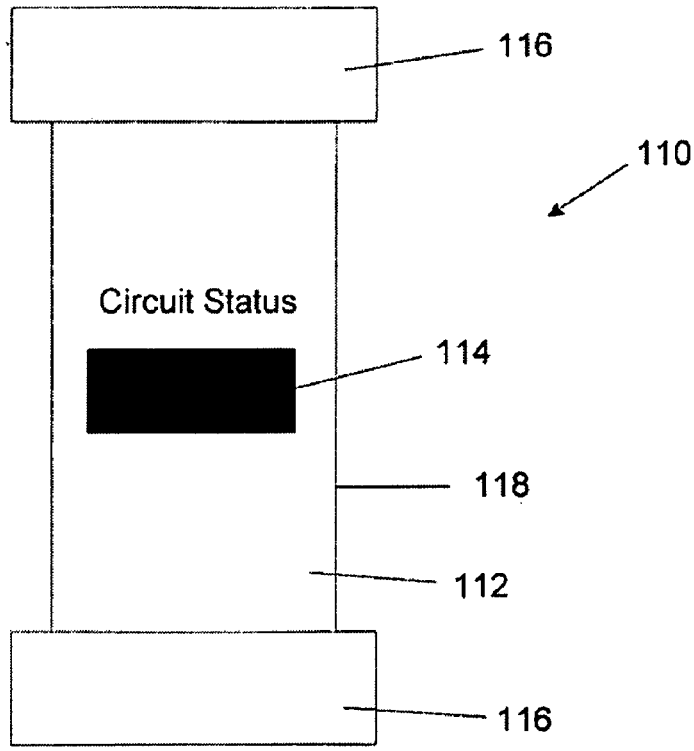
FIG. 11A is a top view of a fuse comprising a fuse state indicator displaying an off fuse state in accordance with an exemplary embodiment.
Figure 11B:
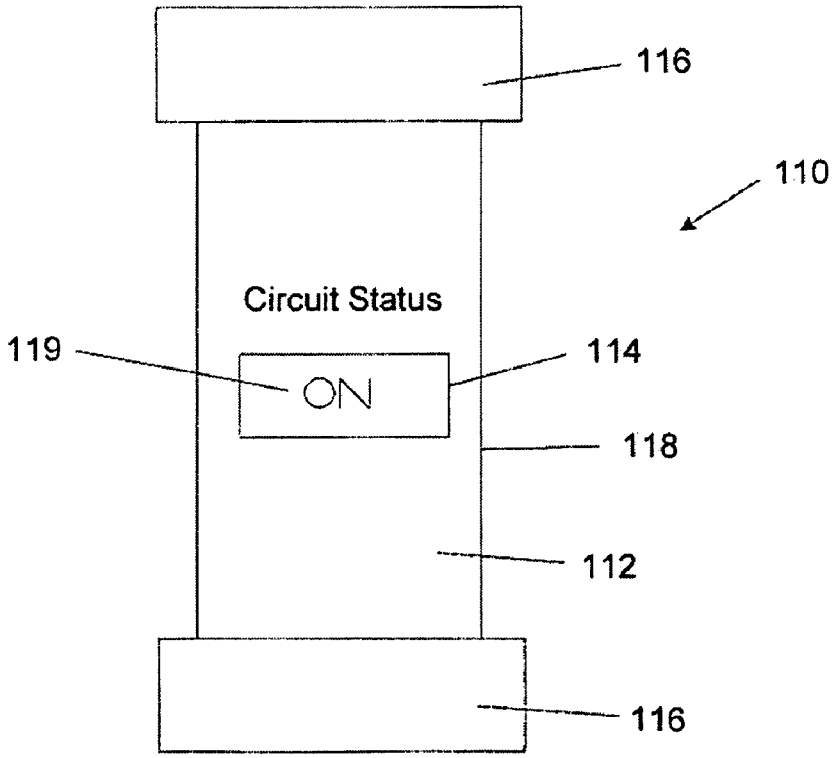
FIG. 11B is a top view of a fuse comprising a fuse state indicator displaying an on fuse state in accordance with an exemplary embodiment.

Referring now to FIGS. 11A and 11B, a top view of a fuse comprising a fuse state indicator displaying a fuse state is described hereinbelow. FIG. 11A is a top view of a fuse comprising a fuse state indicator displaying an off fuse state in accordance with an exemplary embodiment. FIG. 11B is a top view of a fuse comprising a fuse state indicator displaying an on fuse state in accordance with an exemplary embodiment. This embodiment may only indicate an on status and an off status.

The thermochromic liquid crystals used in this embodiment operate similarly to the thermochromic liquid crystals used in the embodiments illustrated in FIGS. 4-10. The fuse 110 comprises a fuse state indicator 112 comprising a temperature sensitive element 114 capable of undergoing a visible change upon being subjected to a particular temperature range. The temperature sensitive element 114 is adapted to visibly indicate the state of fuse 110. In this embodiment, the state of fuse 110 may be indicated as inoperable or operable. The temperature sensitive element 114 may be employed as part of the fuse state indicator 112 coupled to an outer surface 118 of the fuse 110 or the temperature sensitive element 114 may be employed independently. The temperature sensitive element 114 is coupled to the outer surface 118 of the fuse 110 between the ferrules 116 and is not electrically connected to the ferrules 116.

Similar to the temperature sensitive element 52 illustrated in FIGS. 5A and 5B, the temperature sensitive element 114, illustrated in FIGS. 11A and 11B, comprises a transparent lens 53, a plurality of thermochromic liquid crystals 54 adjacent to the transparent lens 53, a backing layer 55 adjacent to the plurality of thermochromic liquid crystals 54 and a fifth marking 119 coupled to the backing layer 55, wherein the fifth marking 119 indicates that the fuse 110 is operational. Although this embodiment uses the word "on" as the fifth marking 119, any marking may be used, including a particular color, e.g. green dot or square, or any other marking associated with an on status, without departing from the scope and spirit of the exemplary embodiment. The fifth marking 119 may be marked on the surface of the backing layer 55 or may be marked on a material directly or indirectly coupled to the backing layer 55.

The temperature sensitive element 114 operates similarly to the temperature sensitive element of FIGS. 5A and 5B. However, in this embodiment the thermochromic liquid crystals are positioned in the first orientation, wherein a substantial portion of the light does not pass through the layer of thermochromic liquid crystals, when exposed to a first temperature range. Furthermore, the thermochromic liquid crystals are positioned in the second orientation, wherein a substantial portion of the light does pass through the layer of thermochromic liquid crystals, when exposed to a temperature range other than the first temperature range. The orientation of the thermochromic liquid crystals of the temperature sensitive element 114 may be reversible.

In an alternate embodiment of that described in FIGS. 4-10, the thermochromic liquid crystals described in FIGS. 1-3 may be used in lieu of the thermochromic liquid crystals used in FIGS. 4-10. In certain alternative embodiments, four (4) distinct kinds of thermochromic liquid crystal may be used for each of the four (4) temperature sensitive elements. A first thermochromic liquid crystal may be used for the off status temperature sensitive element 64, wherein the first thermochromic liquid crystal changes color only when exposed to the first temperature range. A second thermochromic liquid crystal may be used for the on status temperature sensitive element 66, wherein the second thermochromic liquid crystal changes color only when exposed to the second temperature range. A third thermochromic liquid crystal may be used for the too hot status temperature sensitive element 68, wherein the third thermochromic liquid crystal changes color only when exposed to the third temperature range. The color changes associated with the off status temperature sensitive element 64, the on status temperature sensitive element 66, and the too hot status temperature sensitive element 68 may be reversible when the temperature sensitive elements 64, 66, 68 fall outside of the first temperature range, the second temperature range, and the third temperature range, respectively. Furthermore, a fourth thermochromic liquid crystal may be used for the short circuit and overload status temperature sensitive element 70, wherein the fourth thermochromic liquid crystal changes color only when exposed to the fourth temperature range. The color change associated with the short circuit and overload status temperature sensitive element 70 may be irreversible once the short circuit and overload status temperature sensitive element 70 is exposed to the fourth temperature range.

Figure 12:
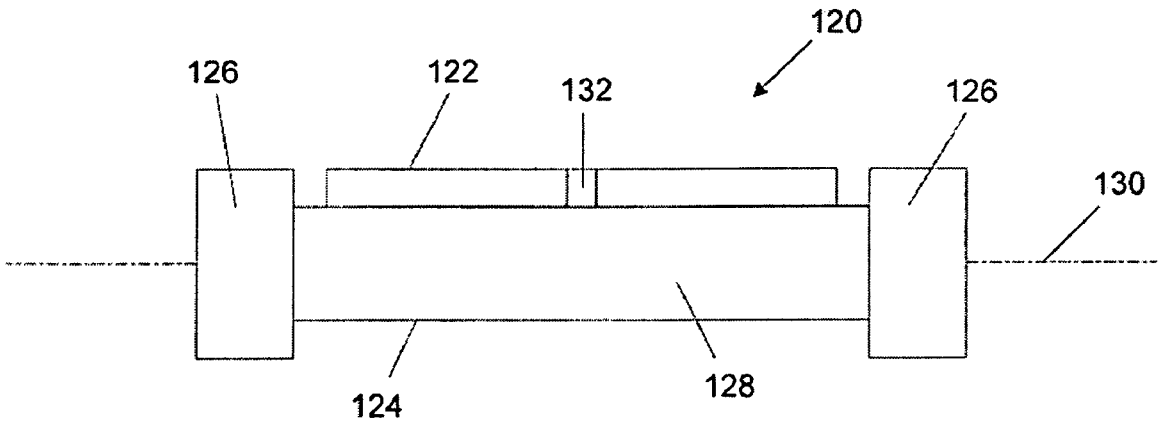
FIG. 12 is a plan view of a fuse comprising a fuse state indicator that responds to temperature in accordance with a third exemplary embodiment.

FIG. 12 is a plan view of a fuse 120 comprising a fuse state indicator 122 that responds to temperature in accordance with a third exemplary embodiment. The fuse 120 includes an insulative (i.e., nonconductive) fuse body 124 and conductive ferrules 126 attached thereto on either end thereof. The fuse state indicator 122 extends on an outer surface 128 of the fuse body 124 between the ferrules 126 and is not electrically connected to the ferrules 126. The fuse body 124 is elongated in the direction of a longitudinal axis 130 and is generally cylindrical in the illustrated embodiment. It is appreciated that the benefits of the instant invention may also apply to non-cylindrical fuses, including but not limited to rectangular fuses, in alternative embodiments. Further, it is understood that the invention is applicable to a wide variety of fuses intended for a wide variety of applications and having a wide variety of fuse ratings. Therefore, the embodiments of the invention shown and described herein are for illustrative purposes only, and the invention is not intended to be restricted to a particular fuse type, class, or rating.

In an exemplary embodiment, the ferrules 126 are generally cylindrical and complementary in shape to the fuse body 124. It is, however, appreciated that the benefits of the instant invention may also apply to non-cylindrical ferrules, including but not limited to rectangular ferrules, in alternative embodiments.

The fuse state indicator 122 comprises at least one temperature sensitive element 132 capable of undergoing a visible change upon being subjected to a particular temperature range. The temperature sensitive element 132 is adapted to visibly indicate the state of fuse 120. The state of fuse 120 may be indicated as inoperable, operable and/or open fuse due to short circuit or overload. The temperature sensitive element 132 may be employed as part of the fuse state indicator 122 coupled to the outer surface 128 of the fuse 120 or the temperature sensitive element 132 may be employed independently. The temperature sensitive element 132 is coupled to the outer surface 128 of the fuse body 124 between the ferrules 126 and is not electrically connected to the ferrules 126.

Figure 13:
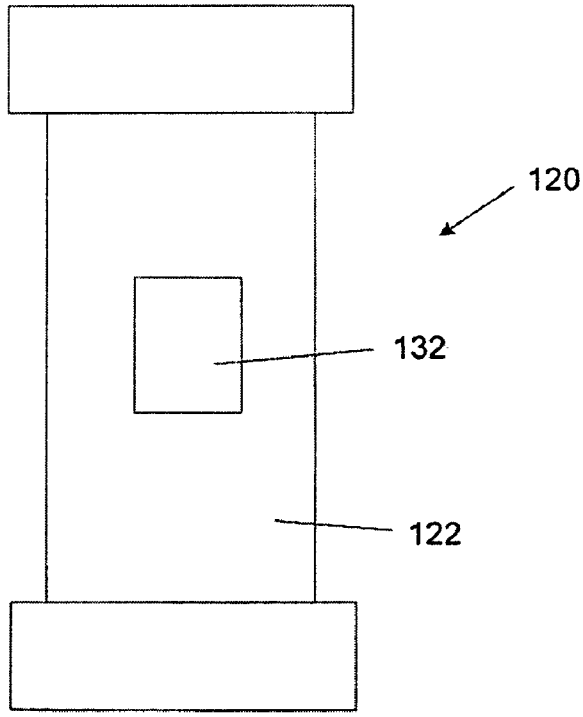
FIG. 13 is a top view of a fuse comprising a fuse state indicator displaying a fuse state in accordance with an exemplary embodiment.

FIG. 13 is a top view of a fuse 120 comprising a fuse state indicator 122 displaying a fuse state in accordance with an exemplary embodiment. As illustrated here, the fuse state indicator 122 comprises the temperature sensitive element 132, which is capable of undergoing a visible change upon being subjected to a particular temperature range. The temperature sensitive element may comprise at least one material selected from a group consisting of thermochromic liquid crystals, thermochromic ink, thermochromic paint, thermal paper, thermal calibrated wax, mercury thermometer, and infrared technology, which are capable of indicating a fuse state upon exposure to a particular temperature range.

Thermochromic inks or dyes are temperature sensitive compounds that temporarily change color with exposure to heat. When using the thermochromic inks or dyes, the color of the ink may change when exposed to the heat generated from the fuse 120 while the fuse 120 is operating. However, when the fuse 120 is not operating, either due to an open fuse, a fuse that has been installed improperly or an open circuit, the color of the ink may be its original color. This color change may be reversible and may allow an operator to easily diagnose the state of the fuse 120.

Thermochromic paints are temperature sensitive pigments that temporarily change color with exposure to heat. After absorbing a certain amount of light or heat, the crystallic or molecular structure of the pigment reversibly changes in such a way that it absorbs and emits light at a different wavelength than at lower temperatures. When using the thermochromic paints, the color of the paint may change when exposed to the heat generated from the fuse 120 while the fuse 120 is operating. However, when the fuse 120 is not operating, either due to an open fuse, a fuse that has been installed improperly or an open circuit, the color of the paint may be its original color. This color change may be reversible and may allow an operator to easily diagnose the state of the fuse 120.

Thermal papers comprise temperature sensitive chemical that change color with exposure to heat. One example of a thermal paper includes paper impregnated with a solid mixture of a fluoran dye with octadecylphosphonic acid. This mixture is stable in solid phase. However, when the octadecylphosphonic acid is melted, the dye undergoes chemical reaction in the liquid phase, and assumes the protonated colored form. Since this color change may not be reversible, the thermal paper may be used to indicate a short circuit or an overload. There may be some color change during normal operation, but the intensity of the color change may increase as the temperature rises into the temperature range associated with a short circuit or an overload.

The fuse state indicator 122 may comprise lettering to describe the fusel 20 and the fuse states. The fuse state indicator 122 may also comprise a color chart for assisting a user in identifying the meaning of the color change. To further assist operators in analyzing the status of the fuse 120, pocket cards comprising color charts may be provided to the operators.

Additionally, although the exemplary embodiment described above illustrates the fuse 120 comprising one temperature sensitive element 132, multiple temperature sensitive elements 132 may be utilized without departing from the scope and spirit of the exemplary embodiment.

Furthermore, although some exemplary embodiments have been described above, it is envisioned that the various temperature sensitive elements that have been described may be used alternatively in lieu of one another or in combination with each other without departing from the scope and spirit of the invention.

In an exemplary embodiment, the 80% current fuse tube temperatures may range from about 35° C. to about 65° C. depending upon the location of the measurement. Additionally, the 500% overload fuse tube temperatures may range from about 45° C. to about 90° C. depending upon the location of the measurement. However, at a particular location, e.g. location of the temperature sensitive element, the temperatures may be more consistent. It should be understood that these ranges may differ among different fuse types, classes and ratings without departing from the scope and spirit of the exemplary embodiment.

In some embodiments, the temperature sensitive element may change colors from green to black at the set temperature point and may remain black when the temperature increases beyond the set temperature point. However, it should be understood that the temperature sensitive element may change colors from any color to any other color without departing from the scope and spirit of the exemplary embodiment.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A fuse state indicator comprising:

a fuse;

at least one temperature sensitive element coupled to the surface of the fuse, wherein the at least one temperature sensitive element is capable of undergoing at least one visible change upon being subjected to a plurality of temperature ranges, wherein the at least one temperature sensitive element detects heat generated from the fuse;

wherein the at least one temperature sensitive element comprises:

a transparent lens;

a plurality of thermochromic liquid crystals adjacent to the transparent lens; and a backing layer adjacent to the plurality of thermochromic crystals;

wherein the plurality of thermochromic liquid crystals are positioned in a first orientation when not exposed to a particular temperature range and are positioned in a second orientation when exposed to the particular temperature range;

wherein the first orientation prevents a substantial portion of light from passing through the plurality of thermochromic liquid crystals and the second orientation allows a substantial portion of light to pass through the plurality of thermochromic liquid crystals; and a marking coupled to the backing layer, wherein the marking indicates a fuse state.

2. The fuse state indicator of claim 1, wherein the at least one visible change comprises at least one color change.

3. The fuse state indicator of claim 2, wherein the temperature sensitive element displays a first color upon exposure to a first temperature range, wherein the first color indicates a first fuse state.

4. The fuse state indicator of claim 3, wherein the first fuse state is an off fuse state and wherein the color change of the temperature sensitive element is reversible when exposed above the first temperature range.

5. The fuse state indicator of claim 3, wherein the temperature sensitive element displays a second color upon exposure to a second temperature range, wherein the second color indicates a second fuse state.

6. The fuse state indicator of claim 5, wherein the second fuse state is an on fuse state and wherein the color change of the temperature sensitive element is reversible when exposed above or below the second temperature range.

7. The fuse state indicator of claim 5, wherein the temperature sensitive element displays a third color upon exposure to a third temperature range, wherein the third color indicates a third fuse state.

8. The fuse state indicator of claim 7, wherein the third fuse state is a too hot fuse state and wherein the color change of the temperature sensitive element is reversible when exposed above or below the third temperature range.

9. The fuse state indicator of claim 7, wherein the temperature sensitive element displays a fourth color upon exposure to a fourth temperature range, wherein the fourth color indicates a fourth fuse state.

10. The fuse state indicator of claim 9, wherein the fourth fuse state is a short circuit and overload fuse state and wherein the color change of the temperature sensitive element is irreversible when exposed to the fourth temperature range.

11. The fuse state indicator of claim 1, wherein the fuse further comprises at least one ferrule and the temperature sensitive element is not electrically coupled to the at least one ferrule.

12. The fuse state indicator of claim 1, wherein the temperature sensitive element comprises a first thermochromic liquid crystal material that changes color only upon exposure to a first temperature range, wherein the first temperature range corresponds to a first fuse state.

13. The fuse state indicator of claim 12, wherein the temperature sensitive element further comprises a second thermochromic liquid crystal that changes color only upon exposure to a second temperature range different from the first temperature range, wherein the second temperature range corresponds to a second fuse state different from the first fuse state.

14. The fuse state indicator of claim 13, wherein the temperature sensitive element further comprises a third thermochromic liquid crystal that changes color only upon exposure to a third temperature range different from the first and second temperature ranges, wherein the third temperature range corresponds to a third fuse state different from the first and second fuse states.

15. The fuse state indicator of claim 14, wherein the temperature sensitive element further comprises a fourth thermochromic liquid crystal that changes color only upon exposure to a fourth temperature range different from the first, second and third temperature ranges, wherein the fourth temperature range corresponds to a fourth fuse state that is different from each of the first, second and third fuse states.

16. The fuse state indicator of claim 1, wherein the particular temperature range corresponds to an off fuse state and the marking indicates the off fuse state.

17. The fuse state indicator of claim 1, wherein the particular temperature range corresponds to an on fuse state and the marking indicates the on fuse state.

18. The fuse state indicator of claim 1, wherein the particular temperature range corresponds to a too hot fuse state and the marking indicates the too hot fuse state.

19. The fuse state indicator of claim 1, wherein the particular temperature range corresponds to a short circuit and overload fuse state and the marking indicates the short circuit and overload fuse state.

* * * * *